US007444684B1

(12) United States Patent
Medina

(10) Patent No.: US 7,444,684 B1
(45) Date of Patent: Nov. 4, 2008

(54) BATH CAPE/TOWEL SYSTEM

(76) Inventor: Debra L. Medina, 8243 Rose Petal Ct., Port Richey, FL (US) 34668-6964

( * ) Notice: Subject to any disclaimer, the term of this patent is extended or adjusted under 35 U.S.C. 154(b) by 0 days.

(21) Appl. No.: 12/004,313

(22) Filed: Dec. 20, 2007

(51) Int. Cl.
*A41D 13/04* (2006.01)

(52) U.S. Cl. ..... 2/48; 2/88

(58) Field of Classification Search ..... 2/88, 2/48, 49.1–49.5, 50, 51, 52, 114, 69.5, 69, 2/46, 47, 104, 85, 87, 92, 118; D2/861, 823, D2/824, 826; D6/608; 5/482, 484, 486, 5/494

See application file for complete search history.

(56) References Cited

U.S. PATENT DOCUMENTS

| | | | | | |
|---|---|---|---|---|---|
| 188,737 | A * | 3/1877 | Hart | 2/50 |
| 363,790 | A * | 5/1887 | Alley | 2/51 |
| 686,631 | A * | 11/1901 | McCathie | 2/49.4 |
| 889,073 | A * | 5/1908 | Walbridge | 2/49.1 |
| 1,193,545 | A * | 8/1916 | Hart | 2/51 |
| 1,257,810 | A * | 2/1918 | Clarke | 2/48 |
| 1,432,249 | A * | 10/1922 | Hoyme | 2/69 |
| 2,722,685 | A * | 11/1955 | Lucas | 2/48 |
| 2,947,004 | A * | 8/1960 | Pfile | 2/50 |
| 4,504,977 | A * | 3/1985 | King et al. | 2/51 |
| 4,685,154 | A * | 8/1987 | Smith | 2/48 |
| 4,710,980 | A * | 12/1987 | Brison et al. | 2/50 |
| 4,862,518 | A * | 9/1989 | Williams et al. | 2/49.1 |
| 4,873,725 | A * | 10/1989 | Mitchell | 2/48 |
| 5,673,433 | A * | 10/1997 | Rothrum | 2/46 |
| D398,140 | S * | 9/1998 | Lion | D2/861 |
| 5,950,235 | A | 9/1999 | Tata | |
| 6,505,367 | B2 | 1/2003 | Griffin | |
| 6,536,047 | B1 * | 3/2003 | Mullaly | 2/48 |
| 6,601,239 | B2 * | 8/2003 | Drake | 2/51 |
| 6,617,487 | B2 * | 9/2003 | Chou | 2/49.1 |
| 7,174,570 | B2 * | 2/2007 | Dabney et al. | 2/48 |
| 7,260,851 | B1 * | 8/2007 | Milnark et al. | 2/52 |
| 2007/0250978 | A1 * | 11/2007 | Peterson | 2/49.1 |

* cited by examiner

*Primary Examiner*—Amy B Vanatta

(57) ABSTRACT

A sheet of toweling material is in a generally rectangular configuration. The sheet has upper, lower and side edges. A neck hole is spaced from the upper edge. A slot couples the hole and the upper edge. Connectors are located on the sheet adjacent to the hole on opposite sides of the slot. A layer of water impervious plastic material is in a generally rectangular configuration. The layer has upper, lower and side edges. The layer is coupled to the sheet between the hole and the lower edge of the sheet. The layer is equally spaced from the side edges of the sheet. The layer is in a generally rectangular configuration. The layer constitutes between 40 percent and 50 percent of the height of the sheet. The layer constitutes between 35 percent and 45 percent of the width of the sheet.

5 Claims, 3 Drawing Sheets

FIG 1
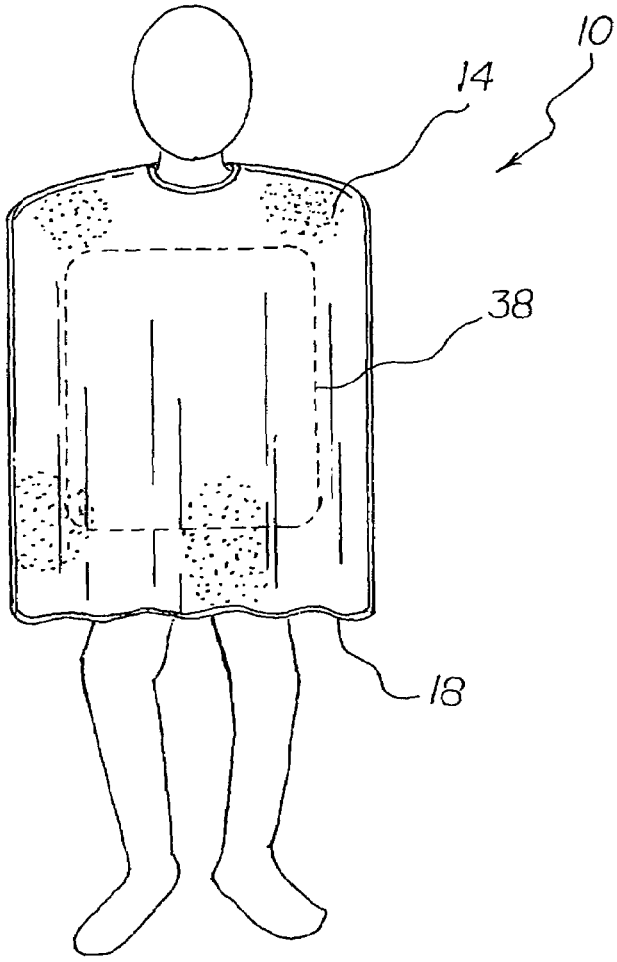
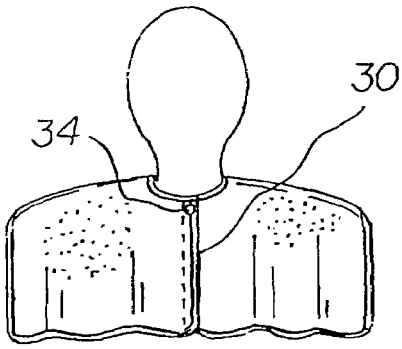
FIG 2

FIG 3
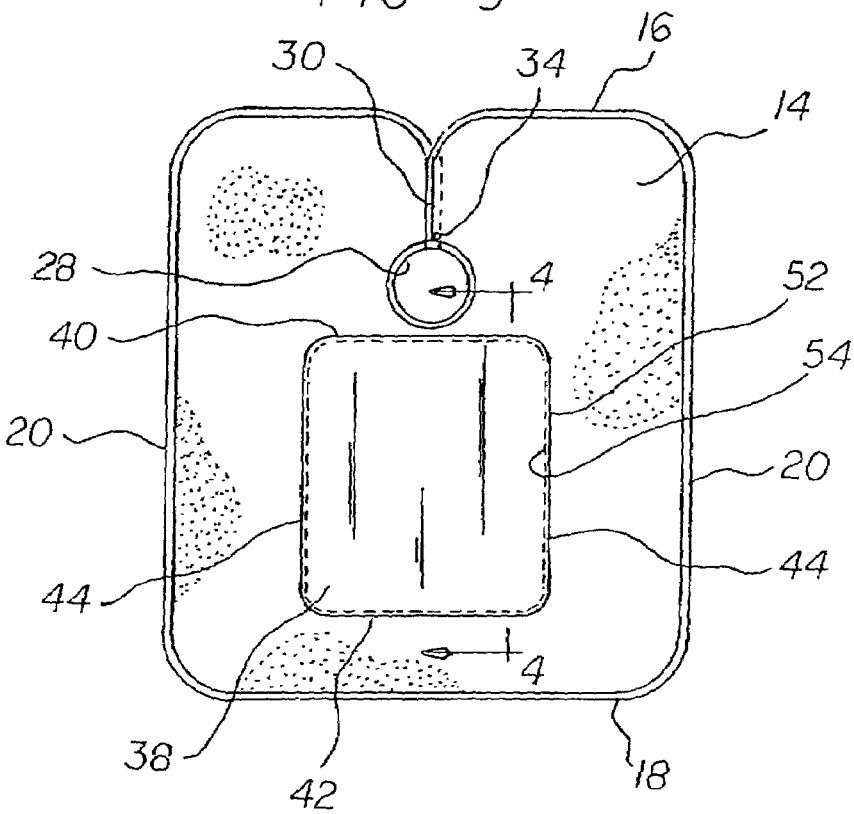
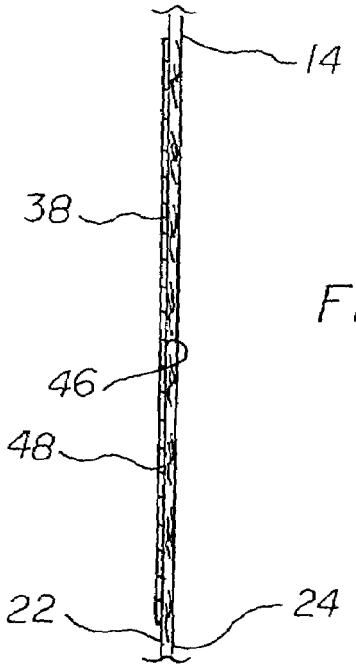
FIG 4

FIG 5
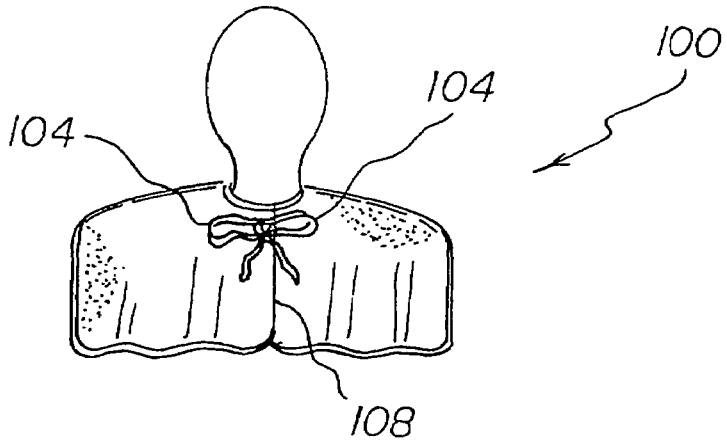
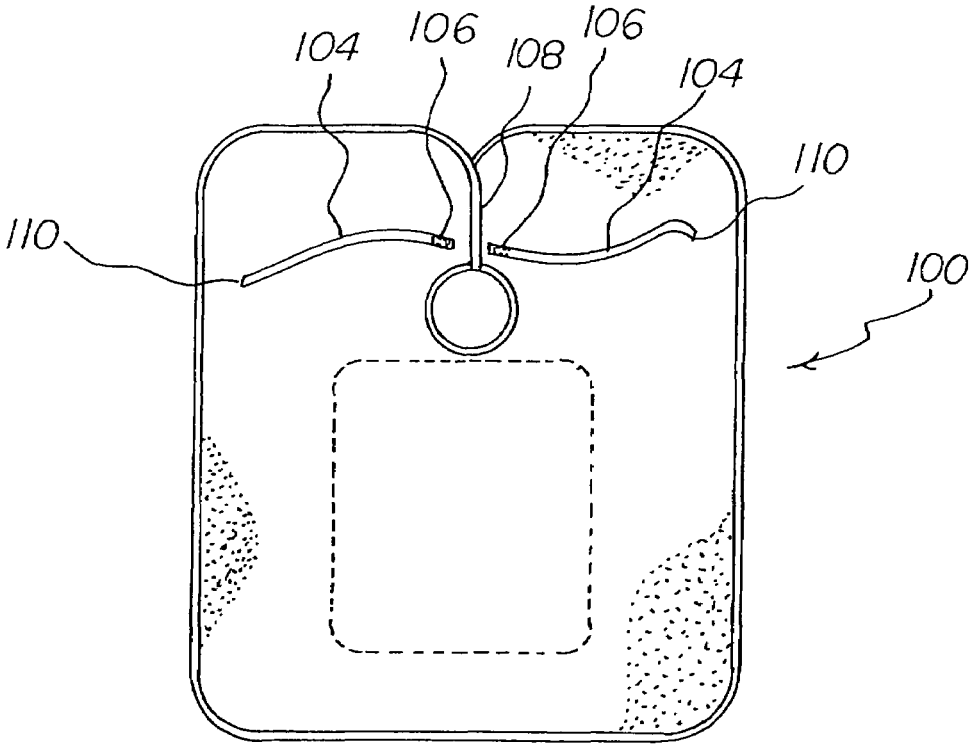
FIG 6

BATH CAPE/TOWEL SYSTEM

BACKGROUND OF THE INVENTION

1. Field of the Invention

The present invention relates to a bath cape/towel system and more particularly pertains to use by an adult care giver when receiving and drying an infant after a bath in a safe, convenient, and economical manner.

2. Description of the Prior Art

The use of protective garments of known designs and configurations is known in the prior art. More specifically, protective garments of known designs and configurations previously devised and utilized for the purpose of protecting clothing through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,590,235 issued Sep. 14, 1999 to Tata relates to a Protective Garment for Use by an Adult Holding a Child and U.S. Pat. No. 6,505,367 issued Jan. 14, 2003 to Griffin relates to a Bath Towel Device and Method for Infants.

While these devices fulfill their respective, particular objectives and requirements, the aforementioned patents do not describe a bath cape/towel system that allows for use by an adult care giver when receiving and drying an infant after a bath in a safe, convenient, and economical manner.

In this respect, the bath cape/towel system according to the present invention substantially departs from the conventional concepts and designs of the prior art, and in doing so provides an apparatus primarily developed for the purpose of use by an adult care giver when receiving and drying an infant after a bath in a safe, convenient, and economical manner.

Therefore, it can be appreciated that there exists a continuing need for a new and improved bath cape/towel system which can be used for use by an adult care giver when receiving and drying an infant after a bath in a safe, convenient, and economical manner. In this regard, the present invention substantially fulfills this need.

SUMMARY OF THE INVENTION

In view of the foregoing disadvantages inherent in the known types of protective garments of known designs and configurations now present in the prior art, the present invention provides an improved bath cape/towel system. As such, the general purpose of the present invention, which will be described subsequently in greater detail, is to provide a new and improved bath cape/towel system and method which has all the advantages of the prior art and none of the disadvantages.

To attain this, the present invention essentially comprises a bath cape/towel system. First provided is a sheet of toweling material. The sheet is fabricated of a pile-type material. The sheet is in a generally rectangular configuration. The sheet has an upper linear edge. The sheet has a parallel lower linear edge. The upper and lower linear edges are spaced by a height of 51 inches, plus or minus 10 percent. The sheet has parallel side edges. The side edges couple the upper and lower edges. The side edges are separated by a width of 48 inches, plus or minus 10 percent. The sheet has an interior surface. The sheet has an exterior surface.

A neck hole is provided. The neck hole is formed in the towel. The neck hole is in a circular configuration. The neck hole has a diameter of about 6 inches. The center of the hole is spaced from the upper edge by about 12 inches. The neck hole has a slot. The slot couples the hole and the upper edge of the sheet.

Provided next are snaps. The snaps are located on the sheet adjacent to the hole on opposite sides of the slot. The snaps are adapted to couple and uncouple the slot. In this manner the system is allowed to be removably coupled around the neck of an adult care giver.

Further provided is a layer of water impervious plastic material. The layer is coupled to the inner surface of the sheet. The layer is located between the hole and the lower edge of the sheet. The layer is equally spaced from the side edges of the sheet. The layer is in a generally rectangular configuration. The layer has an upper linear edge. The layer has a parallel lower linear edge. The upper and lower linear edges are spaced by a height of 23 inches, plus or minus 10 percent. The layer constitutes between 40 percent and 50 percent of the height of the sheet. The layer has parallel side edges. The side edges couple the upper and lower edges of the layer. The side edges are separated by a width of 18 inches, plus or minus 10 percent. The layer constitutes between 35 percent and 45 percent of the width of the sheet. The sheet has an interior surface. The interior surface is positionable adjacent to an adult care giver. In this manner wetting and staining may be abated. Wetting and staining might otherwise occur. The sheet has an exterior surface. The exterior surface is in contact with the interior surface of the sheet.

The layer has a periphery. The periphery of the layer has stitching. The stitching extends through the sheet and the layer adjacent to its periphery. In this manner the layer is coupled to the sheet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bath cape/towel system which has all of the advantages of the prior art protective garments of known designs and configurations and none of the disadvantages.

It is another object of the present invention to provide a new and improved bath cape/towel system which may be easily and efficiently manufactured and marketed.

It is further object of the present invention to provide a new and improved bath cape/towel system which is of durable and reliable constructions.

An even further object of the present invention is to provide a new and improved bath cape/towel system which is susceptible of a low cost of manufacture with regard to both materials and labor, and which accordingly is then susceptible of low prices of sale to the consuming public, thereby making such bath cape/towel system economically available to the buying public.

Even still another object of the present invention is to provide a bath cape/towel system for use by an adult care giver when receiving and drying an infant after a bath in a safe, convenient, and economical manner.

Lastly, it is an object of the present invention to provide a new and improved bath cape/towel system. A sheet of toweling material is in a generally rectangular configuration. The sheet has upper, lower and side edges. A neck hole is spaced from the upper edge. A slot couples the hole and the upper edge. Connectors are located on the sheet adjacent to the hole on opposite sides of the slot. A layer of water impervious plastic material is in a generally rectangular configuration. The layer has upper, lower and side edges. The layer is coupled to the sheet between the hole and the lower edge of the sheet. The layer is equally spaced from the side edges of the sheet. The layer is in a generally rectangular configuration. The layer constitutes between 40 percent and 50 percent of the height of the sheet. The layer constitutes between 35 percent and 45 percent of the width of the sheet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a bath cape/towel system constructed in accordance with the principles of the present invention.

FIG. 2 is a rear elevational view of the upper portion of the system illustrated in FIG. 1.

FIG. 3 is a plan view of the interior surface of the system illustrated in FIGS. 1 and 2.

FIG. 4 is a cross sectional view taken along line 4-4 of FIG. 3.

FIG. 5 is a rear elevational view of the upper portion of the system similar to FIG. 1 but illustrating an alternate embodiment of the invention.

FIG. 6 is a plan view of the interior surface of the system illustrated in FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved bath cape/towel system embodying the principles and concepts of the present invention and generally designated by the reference numeral 10 will be described.

The present invention, the bath cape/towel system 10 is comprised of a plurality of components. Such components in their broadest context include a sheet, a neck hole, connectors and a layer of water impervious plastic material. Such components are individually configured and correlated with respect to each other so as to attain the desired objective.

First provided is a sheet 14 of toweling material. The sheet is fabricated of a pile-type material. The sheet is in a generally rectangular configuration. The sheet has an upper linear edge 16. The sheet has a parallel lower linear edge 18. The upper and lower linear edges are spaced by a height of 51 inches, plus or minus 10 percent. The sheet has parallel side edges 20. The side edges couple the upper and lower edges. The side edges are separated by a width of 48 inches, plus or minus 10 percent. The sheet has an interior surface 22. The sheet has an exterior surface 24.

A neck hole 28 is provided. The neck hole is formed in the towel. The neck hole is in a circular configuration. The neck hole has a diameter of about 6 inches. The center of the hole is spaced from the upper edge by about 12 inches. The neck hole has a slot 30. The slot couples the hole and the upper edge of the sheet.

Provided next are snaps 34. The snaps are located on the sheet adjacent to the hole on opposite sides of the slot. The snaps are adapted to couple and uncouple the slot. In this manner the system is allowed to be removably coupled around the neck of an adult care giver.

Further provided is a layer 38 of water impervious plastic material. The layer is coupled to the inner surface of the sheet. The layer is located between the hole and the lower edge of the sheet. The layer is equally spaced from the side edges of the sheet. The layer is in a generally rectangular configuration. The layer has an upper linear edge 40. The layer has a parallel lower linear edge 42. The upper and lower linear edges are spaced by a height of 23 inches, plus or minus 10 percent. The layer constitutes between 40 percent and 50 percent of the height of the sheet. The layer has parallel side edges 44. The side edges couple the upper and lower edges of the layer. The side edges are separated by a width of 18 inches, plus or minus 10 percent. The layer constitutes between 35 percent and 45 percent of the width of the sheet. The sheet has an interior surface 46. The interior surface is positionable adjacent to an adult care giver. In this manner wetting and staining may be abated. Wetting and staining might otherwise occur. The sheet has an exterior surface 48. The exterior surface is in contact with the interior surface of the sheet.

The layer has a periphery 52. The periphery of the layer has stitching 54. The stitching extends through the sheet and the layer adjacent to its periphery. In this manner the layer is coupled to the sheet.

The preferred embodiment of the invention as described above couples the layer to the sheet by stitching. In alternate embodiments of the invention the coupling is adapted to be achieved through a wide variety of mechanisms, permanent such as stitching and non-permanent such as hook and loop fasteners and snaps and other separable fasteners.

Reference is now made to the alternate embodiment of the invention illustrated in FIGS. 5 and 6. In this alternate embodiment connectors are provided which include a pair of similarly configured tie straps 104. Each strap has a fixed end 106. A slot 108 is provided. The fixed end of the strap is attached to the sheet on opposite sides of the slot. Each strap has a free end 110. The free ends couple the straps together. In this manner the sheet and layer may be removably secured to an adult care giver. The other components of the system are the same as in the primary embodiment of the invention as described herein above and as illustrated in FIGS. 1 through 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bath cape/towel system comprising:

a sheet of toweling material in a generally rectangular configuration with upper and lower and side edges;

a neck hole spaced from the upper edge with a slot coupling the hole and the upper edge;

connectors located on the sheet adjacent to the hole on opposite sides of the slot; and a layer of water impervious plastic material in a generally rectangular configuration with upper and lower and side edges coupled to the sheet between the hole and the lower edge of the sheet and equally spaced from the side edges of the sheet, the layer being in a generally rectangular configuration and constituting between 40 percent and 50 percent of the height of the sheet and constituting between 35 percent and 45 percent of the width of the sheet.

2. The system as set forth in claim 1 wherein the layer has a periphery with stitching extending through the sheet and the layer adjacent to its periphery for the coupling of the layer to the sheet.

3. The system as set forth in claim 1 wherein the connectors are snaps.

4. The system as set forth in claim 1 wherein the connectors include a pair of similarly configured tie straps, each strap having a fixed end attached to the sheet on opposite sides of the slot, each strap having a free end for use in coupling the straps together for removably securing the sheet and layer to an adult care giver.

5. A bath cape/towel system for use by an adult care giver when receiving and drying an infant after a bath in a safe, convenient, and economical manner comprising, in combination:

a sheet of toweling material fabricated of a pile-type material in a generally rectangular configuration having an upper linear edge and a parallel lower linear edge spaced by a height of 51 inches, plus or minus 10 percent, and with parallel side edges coupling the upper and lower edges separated by a width of 48 inches, plus or minus 10 percent, the sheet having an interior surface and an exterior surface;

a neck hole formed in the towel in a circular configuration with a diameter of about 6 inches, the center of the hole being spaced from the upper edge by about 12 inches with a slot coupling the hole and the upper edge of the sheet;

snaps located on the sheet adjacent to the hole on opposite sides of the slot, the snaps adapted to couple and uncouple the slot to allow the system to be removably coupled around the neck of an adult care giver;

a layer of water impervious plastic material coupled to the inner surface of the sheet, the layer being located between the hole and the lower edge of the sheet and equally spaced from the side edges of the sheet, the layer being in a generally rectangular configuration having an upper linear edge and a parallel lower linear edge spaced by a height of 23 inches, plus or minus 10 percent and constituting between 40 percent and 50 percent of the height of the sheet, and with parallel side edges coupling the upper and lower edges of the layer separated by a width of 18 inches, plus or minus 10 percent and constituting between 35 percent and 45 percent of the width of the sheet, the sheet having an interior surface positionable adjacent to an adult care giver to abate wetting and staining which might otherwise occur and an exterior surface in contact with the interior surface of the sheet; and the layer having a periphery with stitching extending through the sheet and the layer adjacent to its periphery for the coupling of the layer to the sheet.

* * * * *